United States Patent [19]

Langseder

[11] 4,211,335

[45] Jul. 8, 1980

[54] FRACTURE RESISTANT RETAINED LEVER TAB AND METHOD OF MANUFACTURE

[75] Inventor: Neal E. Langseder, Hoffman Estates, Ill.

[73] Assignee: American Can Company, Greenwich, Conn.

[21] Appl. No.: 50,649

[22] Filed: Jun. 21, 1979

[51] Int. Cl.[2] ..... B65D 41/32

[52] U.S. Cl. ..... 220/269; 220/273; 113/121 R; 113/121 C

[58] Field of Search ..... 220/269-273; 113/121 C, 121 R, 116 Y

[56] References Cited

U.S. PATENT DOCUMENTS

| | | | |
|---|---|---|---|
| 3,977,561 | 8/1976 | Stroke et al. | 220/269 |
| 4,130,074 | 12/1978 | Cudzik | 113/121 R |
| 4,150,765 | 4/1979 | Mazurek | 220/269 |

*Primary Examiner*—George T. Hall

*Attorney, Agent, or Firm*—Robert P. Auber; Stuart S. Bowie; William C. Hosford

[57] ABSTRACT

A non-detachable fracture resistant lever tab for easy open containers. The tab is provided with a tongue with a high degree of bendability, the tip of which is staked to the central panel wall by means of a rivet. Bendability of the tongue is enhanced through the use of cooperative transitional planes of graduated coining which urge the bend line to form in an area of maximum coining. A method for manufacture of the tab is disclosed.

8 Claims, 7 Drawing Figures

FRACTURE RESISTANT RETAINED LEVER TAB AND METHOD OF MANUFACTURE

BACKGROUND OF THE INVENTION

The market for metal containers has developed widely in recent years due in part to the introduction of the easy open end. While the easy opening feature has been shown to be both effective and convenient, it has given rise to a collateral problem of littering, since traditionally the easy opening feature was pulled free from the container to expose the contents and then subsequently discarded. The indiscriminate disposal of the pull tabs is not only unsightly, but can also present a safety hazard particularly on beaches and in parks. Further, the relatively small size of the separated tab presents a challenge to those concerned with the collection and recycling of waste material. The solution to this problem resides in a non-detachable tab and preferably a tab which is compatible with the end closure and is recycleable.

While the industry has addressed this problem by developing a number of closure structures, one of the more successful has been a can end which employs a retained lever tab. In this structure, the tab is joined to the container end by a tongue or flap which is lanced in the web of the tab, and which serves as a hinge or connecting strip. Typically, the tip of the tongue is apertured and staked to end by means of an integral rivet. Since the tab functions by levering open a scored portion of the end panel, it must be sufficiently rigid to prevent distortion of the curled rim when leverage is applied to the lift end of the tab to effect rupture and displacement of the scored panel. At the same time, the tongue of the tab must be sufficiently bendable to permit the user to open the container and subsequently bend the tab back out of the way into a position of repose. The situation is aggravated by the user's inclination to fatique the tab by bending it back and forth in an effort to free the tab from the container in accordance with past practice.

Typically, tab rigidity is provided by utilizing heavy aluminum tab stock and by curling the edges of the stock to form a tab rim. Such a structure, however, results in a tab tongue which lacks bendability and is prone to fracture when subjected to severe bending, as may be encountered when it is pivoted forward to open the end and then subsequently bent backward to fold the tab out of the way. Fracture of the tongue generally occurs between the terminal ends of the lance and the rivet hole or tongue aperture.

This lack of bendability of the tab tongue can be overcome in part by a more elaborate tab structure, wherein a retaining strip of plastic or ductile aluminum is interleafed into the folds of the tab nose, thereby providing a flexibility and fracture resistant linkage between the tab and the end. Such a structure requires a premium tie strip and appreciable press time for fabrication.

Alternative structures have been proposed using a soft ductile alloy for the tab, but with a more complex configuration as a means for achieving rigidity. In another instance, tin-plated steel has been suggested as a material of construction.

The problems of material recycling and raw edge corrosion or alternatively of increased manufacturing cost, which are attendent with these structures, are not readily resolved.

Accordingly, it is the primary objective of the instant invention to provide a lever tab structure for an easy open end which is sufficiently rigid to operate effectively without distorting, but where the tongue is sufficiently bendable so that it resists fracture and separation from the end despite repeated bending and rebending.

It is further an objective of the instant invention to provide a non-detachable tab structure which does not require a retaining strip and which is simple and economical to manufacture.

Finally, it is an objective of the instant invention to provide a tab structure which is compatible with the can end closure, thereby facilitating material recycling and minimizing corrosion.

SUMMARY OF THE INVENTION

It may be seen that the aforementioned objectives of the invention may be attained in an easy open end closure which comprises; a central panel wall with a peripheral flange, which is joined to the container and where the closure further includes an integral rivet and a displaceable panel located outward of the rivet, and which is substantially defined by a score line. In addition, the closure includes a lever tab for opening the end which is joined to the end panel by means of the rivet. The lever tab has a nose end, a lift end and a central web disposed therebetween. The web is lanced to form a tongue and the tongue is apertured to receive the rivet. A portion of the tongue is fully coined to a maximum depth with adjacent portions of the web coined in transitional planes of graduated depth which cooperate to urge the tongue to bend in the porton of maximum coining, when the tab is pivoted forward and subsequently rebent to a position of repose. It is desirable, that the coined areas merge smoothly into the uncoined areas without sharp lines of delineation therebetween.

It is preferable that the portion of the tongue, which is coined to a maximum depth, be in the form of a band or annulus which circumscribes the aperture, and that the transitional planes of graduated coining include a triangle configured plane located outward of the band and a pair of co-operating transitional planes located along the lateral extremities of the band. A fully coined segment of the band separates the outward transitional plane from the lateral transitional planes. The transitional planes which are coined in graduated depth cooperate to urge the tongue to bend along a line of coining when the tab is pivoted forward to open the container and subsequently rebent to a position of repose.

Advantageously, the outward transitional plane is inclined at an angle of between 4° and 8°, say 6½°, to the upper surface of the web and that the lateral transitional planes are inclined at an angle of between 17° and 21°, say 19°, to the upper surface of the web. It is particularly preferrable that the band be coined to provide a residual thickness of 0.013"-0.010" say 0.0115".

Finally, it is advantageous to manufacture the tab by feeding a strip of tab stock into the progressive tab die of a press, in which the following sequence of operations is carried out. The rivet aperture is punched in the strip, which is then panelled to form the web of the tab, with the aperture included in the web. The strip is sheared outward of the web to form a tab blank with a nose end and a lift end. The edges of the blank are wiped to curl the tab rim. The web of the tab is lanced to form a tongue with the aperture in the tongue tip and the tongue root formed proximate the tab nose. The tongue is displaced from the web plane by the lancing. The portion of the tongue proximate the root is reinserted into the web plane whereas the portion proximate the tip remains out of the web plane. The tab is struck to form the band of thinned metal circumscribing the aperture, and the transitional planes of graduated coining. The curling of the rim is completed and the aperture repunched to the desired size and orientation.

DETAILED DESCRIPTION OF THE ILLUSTRATED EMBODIMENT

Figure 1:
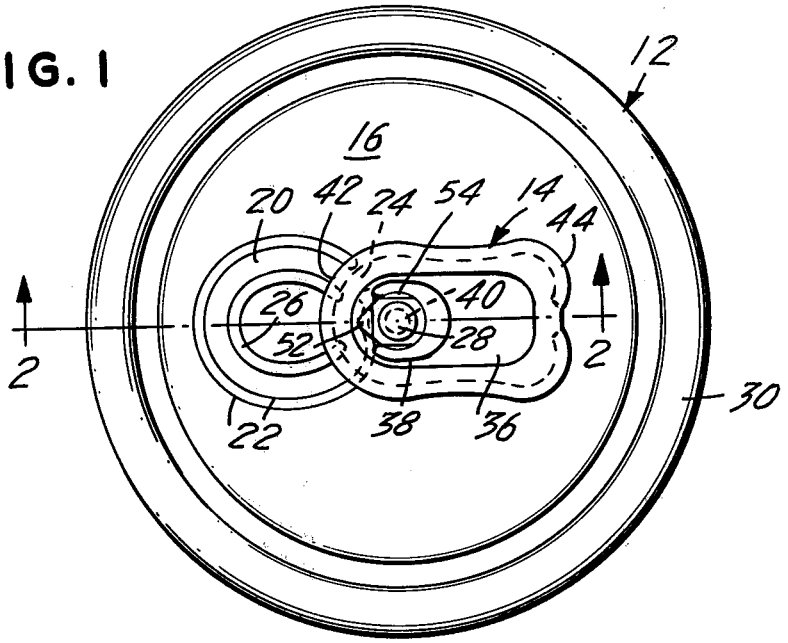
FIG. 1 is a plan view of an end closure embodying the present invention.
Figure 2:
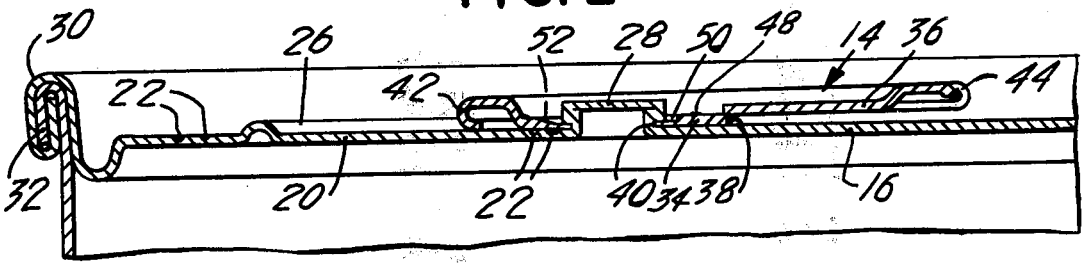
FIG. 2 in an enlarged fragmentary sectional view taken along the line 2—2 of FIG. 1.

Turning now in detail to FIGS. 1 and 2 of the appended drawings, therein illustrated is an easy open end closure 12 with a non-detachable fracture resistant lever tab 14 embodying the present invention. The closure includes a central panel wall 16 with a displaceable pour panel 20 and the fracture resistant lever tab 14. The displaceable panel 20 is substantially defined by a continuous score line 22 with an unscored portion 24 lying between the extremities of the scoring. The unscored portion or neck serves as a hinge for the displaceable panel allowing it to remain attached to the panel wall even after opening. The displaceable pour panel is additionally provided with an upbead 26, which provides structural reinforcement for the panel. The non-detachable fracture resistant tab 14 is a lever type opening device with an aperture 40 for staking to the central panel by means of rivet 28, which is an integral part of the panel wall preferably formed in accordance with the method of U.S. Pat. No. 3,361,102. The end closure is joined to the container wall, as shown in FIG. 2 by a peripheral flange 30, which is folded over the rim 32 of the can body to form a double seam in accordance with conventional practice. Other suitable joining means may be employed with the instant invention.

Figure 3:
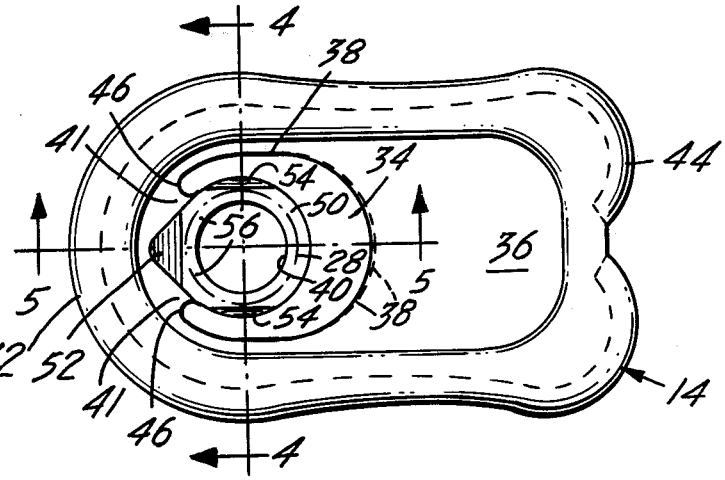
FIG. 3 is an enlarged view of the tab.
Figure 4:
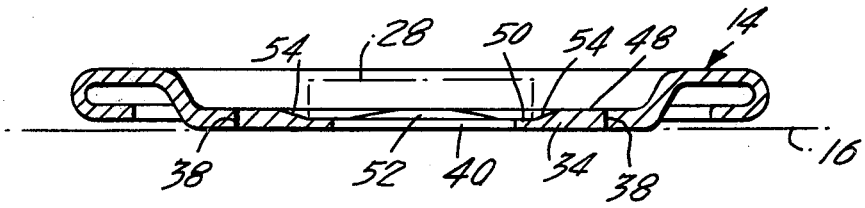
FIG. 4 is an enlarged sectional view of the tab taken along line 4—4 of FIG. 3, and showing the rivet head in phantom.

The opening device 14, as best seen in FIG. 3, is a lever tab with a tongue 34 which is formed by lancing the tab web 36 in a U-shaped configuration 38, which terminates in reverse curls 46 to reduce the chance of web tear during the opening operation. The tab which is formed from 0.0185" tab stock, has a curled rim. The resulting tab is sufficiently rigid to effect the panel opening without distorting the tab. The tab has a longitudinal axis with an outwardly disposed nose 42 at one end, and an inwardly disposed lift 44 at the other end. The tab tongue 34 has its root 41 proximate the tab nose lying between the extremities of the lancing. The tip of the tongue is inwardly directed and has an aperture 40 to receive the integral rivet 28. A band 50 surrounding the aperture is fully coined to a maximum depth to increase the bendability. The coining reduces the thickness of the tab stock from 0.0185" to between 0.0130" and 0.0100" say 0.0115". The 0.0185" tab stock is required to provide the necessary rigidity to the tab to permit it to exert an opening force on the end panel sufficient to effect rupture without allowing the tab to distort. While the resulting tab is rigid, without coining, the tab is susceptable to fracture in the area of the tongue root where a bend line is formed. By reducing the thickness of the stock in the region of the bend line, it is possible to increase the bendability of the tab without seriously impairing its overall rigidity. It has further been found that the bendability of the tongue can be substantially increased by introducing co-operating transitional planes of graduated coining. The transitional planes merge the upper surface 48 of the web with the band 50. In developing this contoured surface, particular attention is given to the breaking or smoothing of sharp corners, so that the intesecting planes flow together. The outward transitional plane 52 is triangular in shape and joins the web proximate the tab nose with the coined band. Two additional transitional planes 54 are located along the lateral extremities of the band. Fully coined segments 56, of the band, separate the outward and lateral transitional planes. These fully coined segments are substantially tangent to the reverse curl portions of the lancing. The outward and lateral transitional planes co-operate to urge the formation of the bend line of the tongue into the fully coined segment 56. In this way, the bendability of the tab can be increased to enable it to withstand in excess of 5 bend-rebend cycles without fracture. Before the coined tab is staked to the central panel wall, the curling of the rim is completed and the aperture repunched to size. By extending the coining to completely encircle the rivet, it is possible to reduce the height of rivet required to effect joining.

Figure 6:
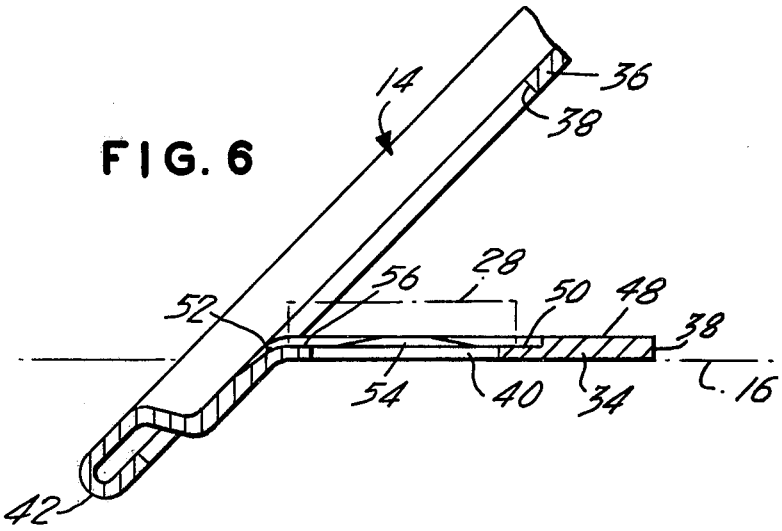
FIG. 6 is a view of the tab of FIG. 5 pivoted forward about a bend line formed in the area of maximum coining.
Figure 7:
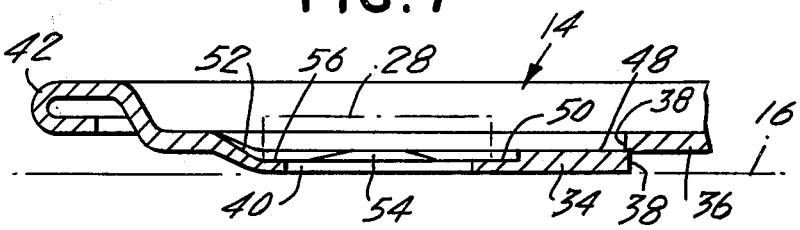
FIG. 7 is a view of the tab of FIG. 6 after the tab has been rebent back to a position of repose.

In operation, the lever tab is employed to open the end closure by inserting a fingernail or object under the curled rim of the tab lift end 44. As the lift end is raised, the tab nose bears against the pour panel proximate reinforcing bead 26 at the same time lifting the panel wall just outward of integral rivet 28 to put the metal of the score line proximate the rivet into shear. As the tab is pivoted forward to first rupture the score line and then to inwardly displace the displaceable panel, the tab tongue is distended in the region of the outward transitional plane 52, and a bend line is formed in the area 56 of maximum coining. FIG. 6 shows the tab in an upstanding posture. FIG. 7 shows the tab in a position of repose with a distended tongue and a bend line outward of the rivet.

Figure 5:
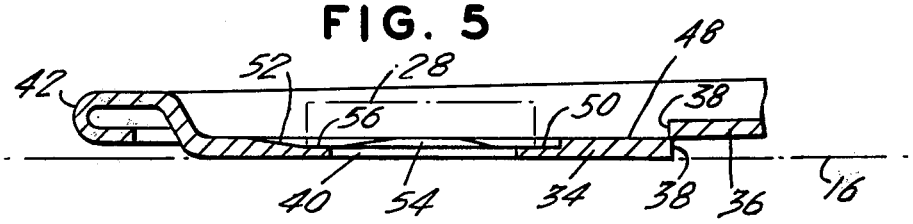
FIG. 5 is an enlarged fragmentary sectional view of the tab taken along line 5—5 of FIG. 3, and showing the rivet head in phantom.

In manufacture, the instant lever tab is formed from aluminum tab stock strip such as 5082-H19 or 5182-H19 of 0.0185" thickness. The strip is fed into a progressive tab die where it is first punched at appropriate intervals to provide rivet holes or apertures 40. The aperture tab stock is then panelled to form the tab web 36. The tab strip is subsequently sheared into discrete tab blanks. The tab blanks are fed individually to the next press station, where the edges of the blanks are wiped to form the rim of the tab as the first step in the tab rim curling process. The web of the tab blank is then lanced in a generally U-shaped configuration 38 with reverse curls 46 at the terminal portions of the lancing. The lancing operation will leave the tongue displaced out of the plane of the web. The portion of the tongue proximate the root is reinserted into the web plane whereas the portion of the tongue proximate the tip remains out of the web plane as best seen in FIG. 5. The displaced tongue tip is caused to undershoot the web, thereby canting the tab. In this way the completed tab when mounted on an end panel will be disposed with the lift end raised slightly to facilitate initiation of the opening sequence. The band surrounding the aperture as well as the transitional planes are coined. The band is fully coined to a residual thickness of 0.0130"–0.0100" say 0.0115". The outward transitional plane 52 which is inclined to the upper surface 48 of the web at an angle of 6–7°, exhibits graduated coining ranging from no coining at the junction with the web surface 48 to full coining with a residual thickness of 0.0130"–0.0100" say 0.0115" at the junction with band 50.

Two additional transitional planes 54 are coined in a graduated manner along the lateral extremities of the band at an angle of inclination of 19°. Before the coined tab is staked to the central panel wall, the curling of the rim is completed and the aperture is repunched to size.

Filed on even date, herewith, is an application in the name of Charles S. Radtke, entitled *FRACTURE AND TEAR RESISTANT RETAINED TAB* and bearing Ser. No. 050,647; the specification thereof is hereby incorporated by reference.

Thus it can be seen that the instant invention provides lever tab structure for an easy open end which is sufficiently rigid to permit effective operation, but with a bendable tongue which resists fracture and ensures retention. Further, the tab structure is simple, requiring no separate retaining strip and lending itself to economical manufacture and recycling without the attendant problem of susceptibility to corrosion.

It is believed that the foregoing general and detailed descriptions are explanatory of the present invention. It will be apparent that modification may be made without departing from the spirit and scope of the invention as defined by the appended claims.

What is claimed is:

1. An easy open closure for a container comprising:

(a) a central panel wall including a peripheral flange for joining said closure to said container and an integral rivet;

(b) a displaceable panel in said central panel wall disposed outwardly of said rivet and substantially defined by scoring; and (c) a lever tab with a tab nose and a tab lift and a central web disposed therebetween and wherein said tab web is lanced to form a tongue with said tongue joined to said central panel wall by means of said rivet and wherein a portion of said tongue is coined to a maximum depth and wherein adjacent portions of said web are coined in transitional planes of graduated depth, whereby said tongue is co-operatively urged to bend in said portion of maximum coining when said tab is pivoted forward and subsequently rebent to a position of repose.

2. The closure as recited in claim 1 wherein said coined areas of said web merge smoothly into said uncoined areas without sharp lines of delineation between said coined and said uncoined areas.

3. An easy open closure for a container comprising:

(a) a central panel wall including a peripheral flange for joining said closure to said container and an integral rivet;

(b) a displaceable panel in said central panel wall disposed outwardly of said rivet and defined by scoring; and (c) a lever tab with a longitudinal axis and a tab nose at one end thereof and a tab lift at the other end thereof and a central web disposed therebetween and wherein said tab web is lanced to form a tongue with its root proximate said tab nose and wherein its tip is apertured and staked to said central panel by means of said integral rivet and wherein a portion of said tongue is coined to a maximum depth to form a band circumscribing said aperture and wherein a transitional plane of triangular configuration is disposed outward of said band and wherein co-operating transitional planes are disposed along the lateral extremities of said band with fully coined segments of said band separating said outward transitional plane from said lateral transitional planes and wherein said transitional planes have graduated coining which co-operate to urge said tongue to bend along a line of maximum coining when said tab is pivoted forward to open said container and subsequently rebent to a position of repose.

4. The closure as recited in claim 3, wherein said outward transitional plane is inclined at an angle of between 5°–8° with respect to the upper surface of the web, and wherein said lateral transitional planes are inclined at an angle of between 14° and 24°.

5. The closure as recited in claim 3, wherein said outward transitional plane is inclined at an angle of 6½° with respect to the upper surface of said web and wherein said lateral transitional planes are inclined at an angle of 19° to the upper surface of said web.

6. The closure as recited in claim 3, wherein the residual thickness of said band after coining is between 0.0130" and 0.0100".

7. An opening device for use with an easy opening container, comprising:

(a) a longitudinal lever tab with a curled rim;

(b) a nose disposed at one end of the said tab;

(c) a lift disposed at the end of said tab opposite said nose;

(d) a central web disposed within said rim and lying between said tab nose and said lift;

(e) a tongue formed in said web by a U-shaped lance with the root of said tongue proximate said tab nose and the tip of said tongue disposed toward said tab lift, and wherein said tongue tip is apertured to receive a rivet;

(f) a band circumscribing said aperture coined in said tongue to a maximum depth;

(g) a transitional plane disposed between said tab nose and said aperture and coined in graduating depth to smoothly merge the upper surface of said web with said band; and (h) a pair of transitional planes disposed laterally of said aperture and coined in graduating depth to smoothly merge the upper surface of said web with said band and whereby said transitional planes cooperate to provide a bend directing influence on said tongue when said tongue is subjected to a bending force as in the opening of a container.

8. A method for forming a lever tab for an easy open closure comprising the steps of:

(a) feeding a strip of tab stock into a progressive tab die;

(b) punching an aperture in said strip;

(c) panelling said strip to form a web with said aperture included therein;

(d) shearing said strip outward of said web to form a tab blank with a nose and a lift;

(e) wiping up the edges of said blank to curl the rim;

(f) lancing said web to form a tongue with said aperture located in the tip of said tongue and the root of said tongue proximate said tab nose;

(g) striking said web to form a band of thinned metal circumscribing said aperture with an outward triangular transitional plane of graduated coining and with the lateral extremities of said annulus forming co-operating transitional planes of graduated coining;

(h) completing the curling of said rim; and (i) repunching said aperture to desired size and orientation.

* * * * *